United States Patent [19]

Kutz

[11] 4,031,736

[45] June 28, 1977

[54] WORKPIECE MANIPULATOR FOR USE IN A FORGING PRESS

[75] Inventor: Heinrich Kutz, Neuss, Germany

[73] Assignee: Schloemann-Siemag Aktiengesellschaft, Germany

[22] Filed: July 14, 1976

[21] Appl. No.: 705,016

[30] Foreign Application Priority Data

July 24, 1975 Germany ..... 2533055

[52] U.S. Cl. ..... 72/422; 72/420; 72/453.18

[51] Int. Cl.[2] ..... B21D 43/10; B21J 13/10

[58] Field of Search ..... 72/420, 421, 422, 361, 72/453.18, 21

[56] References Cited

UNITED STATES PATENTS

| | | | |
|---|---|---|---|
| 2,864,271 | 12/1950 | Kendall | 72/421 |
| 3,427,853 | 2/1969 | Thomas | 72/420 |
| 3,473,364 | 10/1969 | Ross | 72/420 |
| 3,557,601 | 1/1971 | Schüssler | 72/422 |
| 3,590,616 | 7/1971 | Schüssler | 72/421 X |
| 3,863,488 | 2/1975 | Deordies | 72/453.18 |

*Primary Examiner*—Leon Gilden

[57] ABSTRACT

A workpiece manipulator for holding workpieces being forged by a forging press has a tongs holder which moves with a parallel motion. The parallel motion is actuated by a hydraulic cylinder, and in the circuit which feeds this cylinder, there is a second cylinder connected to a pressure reservoir. When the pressure rises in the first cylinder during a forging stroke, the piston of the second cylinder yields to allow the first cylinder to actuate the necessary parallel motion.

3 Claims, 1 Drawing Figure

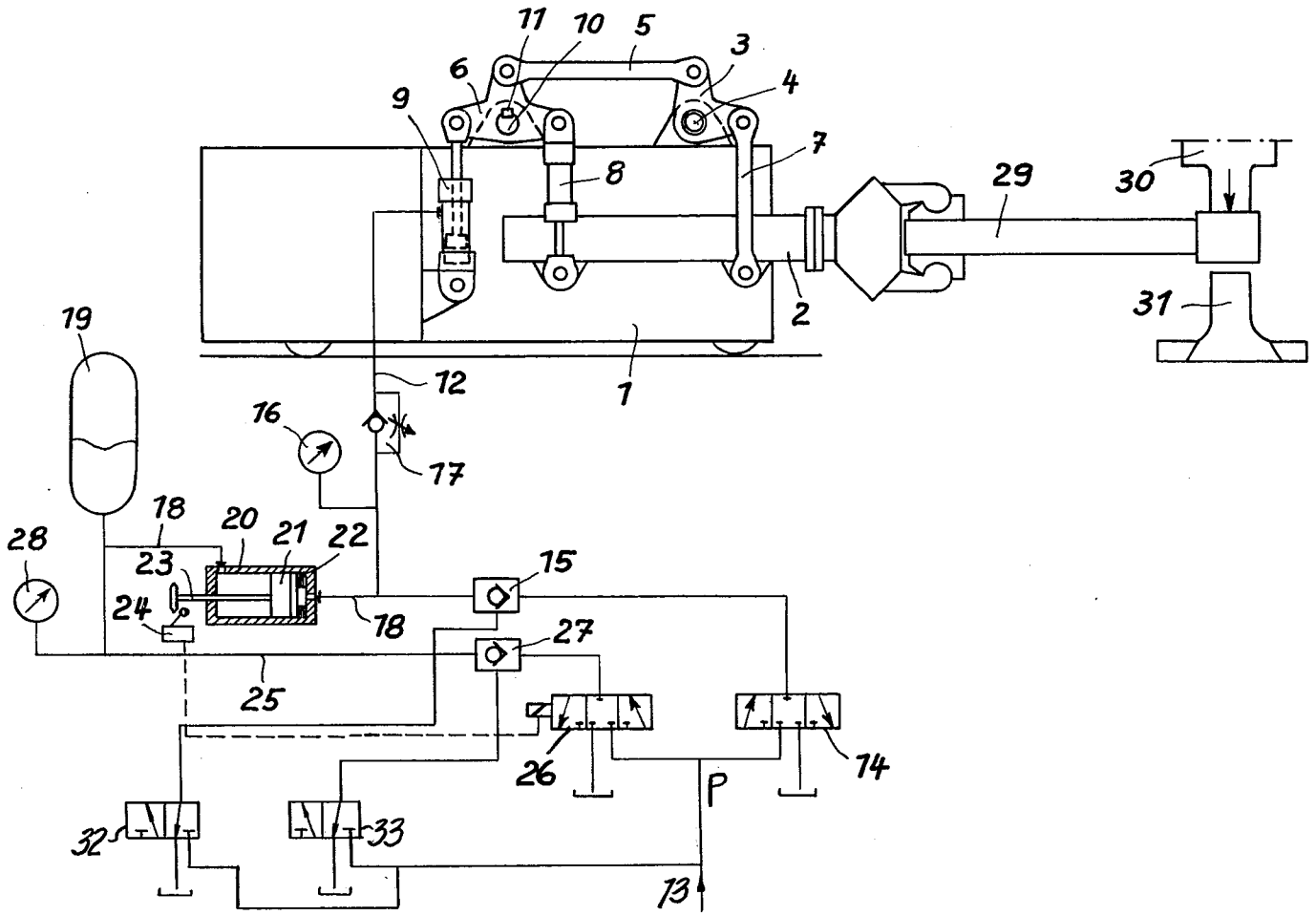
30
31
29
2
7
4
3
5
8
1
10
11
6
9
12
77
16
15
27
74
P
13
26
18
22
21
20
25
33
18
23
24
19
28
32

WORKPIECE MANIPULATOR FOR USE IN A FORGING PRESS

This invention relates to a forging-press workpiece manipulator, such as is used for gripping and moving a workpiece being forged in a forging press.

The purpose of manipulators for hammer forging presses is, inter alia, to move the workpiece into a new working position in the time interval between two working strokes of the press. To this end the workpiece has to be lifted from the lower press tool in order for it to be moved to a further forging stage. During each forging stroke, the tongs and tongs holder should be able to be pressed down with the workpiece, while maintaining a parallel motion, from the upper tool of the press on to the lower tool, against a resilient restoring force, without the workpiece deforming due to a too high elastic force.

The invention provides a workpiece manipulator as set forth in claim 1.

In the present invention the hydraulic actuating cylinder is not resiliently mounted. Vertical resilience of the tongs holder is attained in that when a set pressure is exceeded, pressurised fluid from the actuating cylinder is pressed into the yielding cylinder against a piston, on the other side of which is fluid fed from a pressure reservoir. The pressure is set by feeding or releasing a determined quantity of pressurised fluid to or from the pressure reservoir.

The pressure yielding cylinder preferably has a stop situated at the base of the cylinder which the piston can lie against. A switching rod disposed on the piston and led through the front end of the pressure yielding cylinder advantageously co-operates with a switch contact provided outside the pressure yielding cylinder. The end position of the piston at the stop is visible and can be measured from the outside. Consequently, feeding of further pressure to the pressure reservoir to adjust the hydraulic resilience can be immediately stopped when the piston reaches its end position. Such an exact adjustment cannot be attained with the help of pressure gauges alone.

The hydraulic outlay with this construction is substantially reduced relative to previous known constructions. No additional space-consuming components are required in the region of the parallel linkages. Furthermore the suspension of the tongs holder is relatively simple.

One embodiment of the invention is described in detail, by way of example, with reference to the accompanying drawing.

A tongs holder 2 is suspended from a manipulator chassis 1 by means of a parallel linkage system. The parts of the linkage on one side only of the holder 2 are shown in the drawing, but identical parts lie on the other side of the holder. A front pair of bell-crank levers 3 is suspended on a shaft 4 on the manipulator chassis 1 and is connected by means of a pair of links 5 to a rear pair of crank levers 6. The tongs holder 2 is articulatedly connected to the levers 3, 6 by a pair of draw rods 7 at the front and a pair of press rods 8 at the rear, this latter pair being shown in the drawing as a pair of pressure cylinders 8. The pair of pressure cylinders 8 serves only for any required adjustment of the inclination of the tongs holder 2, and otherwise behaves as a rigid strut. The control system for the pressure cylinder 8 is therefore deliberately not illustrated.

The rear pair of crank levers 6, to which lifting cylinders 9 are hinged, is rigidly connected to a shaft 10 by keys 11. Alternatively, the actuating cylinders 9 may instead be connected to the crank levers 3, in which case synchronisation would take place via the shaft 4.

The actuating cylinders 9 are connected to a hydraulic pump 13 by lines 12, control being exercised by way of a multi-way valve 14. Due to pressure losses through leakage in the valve 14, an excludable non-return valve 15 is provided in the line 12 to prevent sinking of the cylinder 9. This valve 15 can however be excluded from the circuit by operation of a separate control valve 32, when it is desired to lower the tongs holder 2 by discharging fluid from the cylinder 9. A pressure gauge 16 and a combined adjustable throttle and non-return valve 17 are also disposed in the line 12.

The actuating cylinders 9 are connected to a pressure reservoir 19 by way of a branch 18 from the line 12. A cylinder 20 is provided in this branch 18, and has a piston 21 which is urged against a stop 22 situated in the cylinder, under the pressure of a pressure reservoir 19. The other side of the piston 21 is acted upon by fluid from the cylinders 9 via line 12. A switching rod 23 is connected to the piston 21, and is led through the left hand end wall of the pressure yielding cylinder 20 to the outside to co-operate with a switch 24 provided there.

The pressure reservoir 19 is connected to the hydraulic pump 13 by way of a line 25 and a multi-way valve 26 for the feed and release of pressurised oil. An excludable non-return valve 27, which can be excluded by operation of control valve 33, is also disposed in the line 25. A pressure gauge 28 connected to the line 25 serves for checking the pressure in the pressure reservoir 19.

Before the start of a forging stroke, the tongs holder 2 with a workpiece 29 gripped by the tongs is brought into the rest or upper position, shown in the drawing, by pressurising the actuating cylinder 9 via the multi-way valve 14. To carry out the forging stroke, the upper tool 30 presses the workpiece 19 down onto a lower tool 31. Because of the linkage by which the tongs holder 2 is mounted on the chassis 1, the holder will be constrained to move with a parallel motion, and the piston of the actuating cylinder 9 will have to rise. This gives rise to an increase in pressure inside the cylinder 9, and this pressure is transmitted via the lines 12 and 18 to the right-hand side of the piston 21. The increase in pressure causes the piston to move to the left while the forging stroke is being carried out. (During the forging stroke, the switch 24 is switched out and is not effective). When the forging tools 30 and 31 again separate, the pressure inside the cylinder 9 will drop, and the piston 21 will once again be moved to the right by the pressure in the pressure reservoir 19. The pressure will be arranged so that the piston 21 is biassed fully to the right and abuts against the stop 22. The workpiece can then again be accurately set into its rest position by the cylinder 9.

The load on the workpiece 29 is indicated indirectly on the pressure gauge 16.

If the workpiece 29 is too heavy for the setting of the manipulator, there will once again be a high pressure in the actuating cylinder 9 which will result in the piston 21 being pushed to the left. If this is the case, it will not be possible to accurately bring the workpiece into its correct position before forging, and so it will be necessary to increase the pressure in the pressure reservoir 19 so that the piston 21 once again abuts the stop 22. The switching rod 23 and the switch contact 24 can detect this condition as soon as it occurs, and therefore the pressure in the reservoir 19 (indicated on the gauge 28) can be very accurately controlled so that the piston 21 is just contacting the stop 22.

If it is necessary to raise the pressure in the reservoir 19, this can be done by operating the multi-way valve 26. The valve can be actuated by an operator on observation of the contact 24, or alternatively there can be an automatic electrical connection between the contact 24 and the valve 26 which causes immediate actuation when the piston 21 moves off the stop 22.

I claim:

1. A workpiece manipulator for use with a forging press, the manipulator comprising:

a mobile chassis;

a pair of tongs for gripping a workpiece;

a tongs holder to which the tongs are attached;

a parallel motion linkage connecting the tongs holder to the chassis;

a hydraulic piston/cylinder actuating unit for actuating the linkage to cause the tongs holder to be moved with a parallel motion;

a hydraulic circuit connected to said actuating unit;

a second piston/cylinder unit in said circuit, the piston of which is biassed on one side by hydraulic fluid from said actuating unit; and a pressure reservoir in said circuit, which contains hydraulic fluid which biasses the other side of the piston of said second unit, whereby an increase in pressure in said actuating unit causes the piston of the second unit to move against the pressure from the pressure reservoir to allow movement of the actuating unit piston to move the tongs holder.

2. A workpiece manipulator as claimed in claim 1, wherein a stop for the piston is provided in the cylinder of the second unit, and the piston abuts the stop when the tongs holder is in its rest position.

3. A workpiece manipulator as claimed in claim 2, wherein a switch is provided externally of the second cylinder unit to sense movement of the piston of the second unit away from the stop, and a switching rod attached to the piston extends out of the second cylinder unit, and actuates the switch.

* * * * *